US008593493B2

(12) United States Patent
Ohishi

(10) Patent No.: US 8,593,493 B2
(45) Date of Patent: Nov. 26, 2013

(54) DISPLAY DEVICE AND CONTROL METHOD OF DISPLAY DEVICE

(75) Inventor: Hiroshi Ohishi, Yokohama (JP)

(73) Assignee: Samsung Display Co., Ltd. (KR)

( * ) Notice: Subject to any disclaimer, the term of this patent is extended or adjusted under 35 U.S.C. 154(b) by 43 days.

(21) Appl. No.: 13/325,592

(22) Filed: Dec. 14, 2011

(65) Prior Publication Data

US 2012/0154454 A1 Jun. 21, 2012

(30) Foreign Application Priority Data

Dec. 17, 2010 (JP) ..... 2010-282309
Oct. 11, 2011 (KR) ..... 10-2011-0103808

(51) Int. Cl.
*G09G 5/10* (2006.01)

(52) U.S. Cl.
USPC ..... 345/690; 345/99; 345/102

(58) Field of Classification Search
USPC ..... 345/99, 102, 690, 691
See application file for complete search history.

(56) References Cited

U.S. PATENT DOCUMENTS 6,657,622 B2 12/2003 Park
2007/0262944 A1 * 11/2007 Chen ..... 345/98
2009/0244052 A1 * 10/2009 Takahashi ..... 345/213
2010/0302214 A1 12/2010 Kim et al.
2011/0148941 A1 * 6/2011 Kim et al. ..... 345/690

FOREIGN PATENT DOCUMENTS

JP 4367895 B2 9/2009
JP 2009-294637 A 12/2009
KR 1020100135643 A 12/2010

* cited by examiner

*Primary Examiner* — Seokyun Moon
*Assistant Examiner* — Robin Mak
(74) *Attorney, Agent, or Firm* — Cantor Colburn LLP

(57) ABSTRACT

A display device includes a liquid crystal panel including a plurality of regions, where each of the regions includes a plurality of liquid crystal pixels; a plurality of data driving units; and a plurality of timing controllers, where the data driving units is in a one-to-one correspondence with the regions, where each of the data driving units controls transmittance of light of the liquid crystal pixels in a corresponding region thereof, where the timing controllers is in a one-to-one correspondence with the data driving units, where each of the timing controllers acquires data of a partial image to be displayed at the corresponding region of the corresponding data driving unit thereof, generates control data for controlling transmittance of light of the liquid crystal pixels of the corresponding region of the corresponding data driving unit thereof, and outputs the control data to the corresponding data driving unit thereof.

12 Claims, 7 Drawing Sheets

DISPLAY DEVICE AND CONTROL METHOD OF DISPLAY DEVICE

This application claims priority to Japanese Patent Application No. 2010-282309, filed on Dec. 17, 2010, and Korean Patent Application No. 10-2011-0103808, filed on Oct. 11, 2011, and all the benefits accruing therefrom under U.S.C. §119, the contents of which in their entireties are herein incorporated by reference.

BACKGROUND OF THE INVENTION (1) Field of the Invention

Exemplary embodiments relate to a display device, and more particularly, relate to a display device including a plurality of backlights that generates light to a liquid crystal panel and adjusts intensity of the light from each of the backlights and a control method of the display device.

(2) Description of the Related Art

A liquid crystal display device, which displays images using a liquid crystal panel, may include a backlight for generating light to a liquid crystal panel.

The liquid crystal panel may include a first substrate, a second substrate facing the first substrate, a liquid crystal layer disposed between the first substrate and the second substrate, and a plurality of pixels. Images may be displayed by adjusting the transmittance of light at each pixel of the liquid crystal panel. For liquid crystal, it may be difficult to block the light substantially entirely. Accordingly, it may be difficult to improve the contrast of images displayed by the liquid crystal display device.

A technique for improving the contrast of images may include local dimming. In the local dimming, a backlight area may be divided into a plurality of regions, and amount of light emitted to the plurality of regions may be controlled. This technique is generally disclosed in Japanese Patent Publication No. 2009-294637.

In recent, high resolution may be used for a large-sized liquid crystal panel having an increased number of pixels of a liquid crystal panel. Thus, an operating frequency of a driver circuit of the large-sized liquid crystal panel may be substantially increased. However, a driver circuit operating at a high frequency may not be effectively designed, and a manufacturing cost of a display device may increase.

BRIEF SUMMARY OF THE INVENTION

According to an exemplary embodiment of the invention, a display device includes a liquid crystal panel including a plurality of regions, where each of the plurality of regions includes a plurality of liquid crystal pixels; a plurality of data driving units; and a plurality of timing controllers, where the plurality of data driving units is in a one-to-one correspondence with the plurality of regions, where each of the plurality of data driving units controls transmittance of light of the plurality of liquid crystal pixels in a corresponding region thereof, where the plurality of timing controllers is in a one-to-one correspondence with the plurality of data driving units, where each of the plurality of timing controllers acquires data of a partial image to be displayed at the corresponding region of the corresponding data driving unit thereof, generates control data for controlling transmittance of light of the plurality of liquid crystal pixels of the corresponding region of the corresponding data driving unit thereof, and outputs the control data to the corresponding data driving unit thereof.

In an exemplary embodiment, the display device may further include a plurality of backlight units, where each of the plurality of backlight units emits light to the plurality of the liquid crystal pixels controlled by one of the plurality of data driving units, wherein each of the plurality of timing controllers includes: a luminance distribution extracting unit which extracts luminance distribution information of the partial image; and a pixel compensation unit which compensates for the transmittance of light of the plurality of liquid crystal pixels in the corresponding region of the corresponding data driver based on a light emitting level of the plurality of backlight units, where each of the plurality of timing controllers is one of a master timing controller and a slave timing controller, and where the master timing controller of the plurality of timing controllers calculates a light emitting level of each of the plurality of backlight units based on the luminance distribution information extracted by the luminance distribution extracting unit of the plurality of timing controllers.

In an exemplary embodiment, the master timing controller of the plurality of timing controllers may send a request on the luminance distribution information to the slave timing controller of the plurality of timing controllers, and when the master timing controller of the plurality of timing controllers does not receive a response to the request on the luminance distribution information from the slave timing controller of the plurality of timing controllers within a predetermined time, the master timing controller of the plurality of timing controllers may set a light emitting level of a backlight unit, which emits light to the plurality of liquid crystal pixels controlled by the corresponding data driving unit of the slave timing controller of the plurality of timing controllers, to a maximum level.

In an exemplary embodiment, the master timing controller may send a request on the luminance distribution information to the slave timing controller, and when a checksum error occurs at the luminance distribution information received as a response to the request on the luminance distribution information to the slave timing controller of the plurality of timing controllers, the master timing controller of the plurality of timing controllers may calculate the light emitting level of each of the plurality of backlight units based on previous luminance distribution information received from the slave timing controller of the plurality of timing controllers before the checksum error.

In an exemplary embodiment, the master timing controller of the plurality of timing controllers may control the light emitting level of each of the plurality of backlight units to be changed substantially slowly.

BRIEF DESCRIPTION OF THE DRAWINGS

The above and other aspects and features will become more apparent by describing in further detail exemplary embodiments thereof with reference to the accompanying drawings, in which.

DETAILED DESCRIPTION OF THE INVENTION

Figure 1:
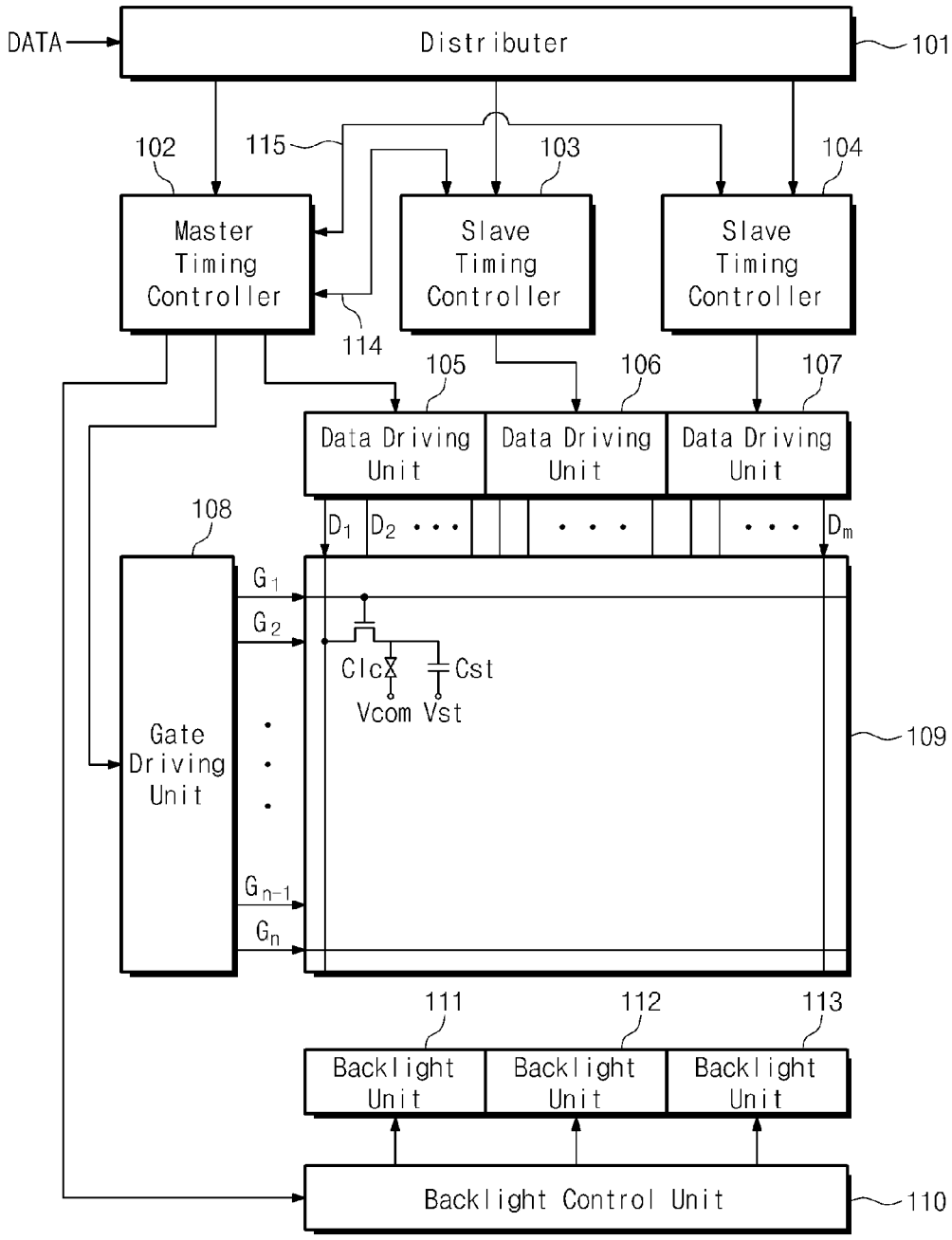
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a block diagram showing an exemplary embodiment of a display device according to the invention.

Referring to FIG. 1, a display device includes a distributer 101, a master timing controller 102, a plurality of slave timing controllers, e.g., a first slave timing controller 103 and a second slave timing controller 104, a plurality of data driving units, e.g., a first data driving unit 105, a second data driving unit 106 and a third data driving unit 107, a gate driving unit 108, a liquid crystal panel 109, a backlight control unit 110, and a plurality of backlight units, e.g., a first backlight unit 111, a second backlight unit 112 and a third backlight unit 113.

The liquid crystal panel 109 may include a plurality of liquid crystal pixels arranged substantially in a matrix form. Each of the liquid crystal pixel may include a switching transistor (e.g., a thin film transistor), a liquid crystal capacitor Clc and a storage capacitor Cst, which are arranged at an intersection of a plurality of gate lines, e.g., a first gate line G1 to an n-th gate line Gn, driven by the gate driving unit 108 and a plurality of data lines, e.g., a first data line D1 to an m-th data line Dm driven by the data driving units 105, 106 and 107. Here, n and m are natural numbers. In an exemplary embodiment, a switching transistor, a liquid crystal capacitor Clc and a storage capacitor Cst may be arranged at an intersection of the gate lines and the data lines such that the liquid crystal pixels are substantially in a matrix form.

Although not shown in FIG. 1, the liquid crystal panel 109 may include a first substrate, a second substrate disposed opposite to, e.g., facing, the first substrate, a liquid crystal layer disposed between the first substrate and the second substrate.

A gate electrode of the switching transistor may be connected to a corresponding gate line of the gate lines, and the switching transistor may be turned on by a voltage transmitted via the gate line. When the switching transistor is turned on, the voltage applied to the corresponding data line may be supplied to the liquid crystal capacitor Clc and the storage capacitor Cst, and the amount of light passed through the liquid crystal pixel may be determined based on a polarization direction of the light passing through the liquid crystal pixel. The light passing through each of the liquid crystal pixels may be generated by the backlight units 111, 112 and 113. Each of the backlight units 111, 112 and 113 may include a light source (not shown), and may generate uniform light provided to the liquid crystal pixels in a corresponding region of the liquid crystal panel 109. In one exemplary embodiment, for example, the light source may be at least one cathode ray tubes or a plurality of light emitting diodes. A light guide plate or a light diffusion sheet (not shown) may be disposed between the light source and the liquid crystal panel 109 to generate the uniform light provided to the liquid crystal pixels.

In an exemplary embodiment of the invention, the liquid crystal panel 109 may include a plurality of regions, each of which corresponds to one of the backlight units 111, 112 and 113. In one exemplary embodiment, for example, the first backlight unit 111 may correspond to a region which includes liquid crystal pixels connected with h data lines, e.g., from the first data line D1 through an h-th data line Dh, via switching transistors. In such an embodiment, the second backlight unit 112 may correspond to a region which includes liquid crystal pixels connected with (i-h) data lines, e.g., an (h+1)-th data line Dh+1 through an i-th data line Di, via switching transistors. In such an embodiment, the third backlight unit 113 may correspond to a region which includes liquid crystal pixels connected with (m-i) data lines, e.g., an (i+1)-th data line Di+1 through the m-th data line Dm, via switching transistors.

In an exemplary embodiment, the light to the liquid crystal pixels in each of the regions of the liquid crystal panel 109 may be mainly generated by a corresponding backlight unit of the back light units.

In an exemplary embodiment, a light guide plate that receives the light generated by the first backlight unit 111 may be disposed opposite to the region which includes liquid crystal pixels connected with the h data lines D1 through Dh via switching transistors. In such an embodiment, a light guide plate that receives the light generated by the second backlight unit 112 may be disposed opposite to the region which includes liquid crystal pixels connected with the (i-h) data lines Dh+1 through Di via switching transistors. In such an embodiment, a light guide plate that receives the light generated by the third backlight unit 113 may be disposed opposite to the region which includes liquid crystal pixels connected with the (m-i) data lines Di+1 through Dm via switching transistors.

In such an embodiment, the first backlight unit 111 may mainly generate the light passing through the region which includes liquid crystal pixels connected with h data lines D1 through Dh via switching transistors. The second backlight unit 112 may mainly generate the light passing through the region which includes liquid crystal pixels connected with the (i-h) data lines Dh+1 through Di via switching transistors. The third backlight unit 113 may mainly generate the light passing through the region which includes liquid crystal pixels connected with (m-i) data lines Di+1 through Dm via switching transistors.

A backlight unit may "mainly" generate light when a substantial portion of the light is generated by the backlight unit while at least a portion of the light is generated by another backlight unit.

In an exemplary embodiment, the liquid crystal panel 109 may include three regions (not shown) corresponding to three backlight units, e.g., the first to third backlight units 111, 112 and 113, respectively. However, the invention is not limited thereto. In an alternative exemplary embodiment, the number of the backlight units may vary, e.g., less than three or greater than three. In an exemplary embodiment, the regions of the liquid crystal panel 109 may extend along a direction where data lines are extending. However, the invention is not limited thereto. In an alternative exemplary embodiment, the regions of the liquid crystal panel 109 may extend along a direction where gate lines are extending. In one exemplary embodiment, for example, the liquid crystal panel 109 may include a region, which includes the liquid crystal pixels connected with the first to j-th gate lines G1 through Gj via switching transistors, and a region which includes the liquid crystal pixels connected with a (j+1)-th to n-th gate lines Gj+1 through Gn via switching transistors. Backlight units may be provided to correspond to the regions, respectively. In such an embodiment, the regions of the liquid crystal panel 109 may extend in a direction where data lines are arranged or in a direction where gate lines are arranged. In an exemplary embodiment, for example, the liquid crystal panel 109 may be divided into k regions arranged in a data line direction and l regions arranged in a gate line direction. That is, the liquid crystal panel 109 may be divided into (k×l) regions. In such an embodiment, (k×l) backlight units may be provided to correspond to the (k×l) regions, respectively. Here, k and l are natural numbers.

The data lines D1 through Dm may be connected to the data driving units 105, 106 and 107. The data driving units 105, 106 and 107 may control voltages applied to the data lines D1 through Dm. In such an embodiment, each of the data driving units 105, 106 and 107 may receive control data, which is used to control the transmittance of light of liquid crystal pixels connected with the data lines via switching transistors, from one of a plurality of timing controllers. Each of the data driving units 105, 106 and 107 may control voltages to be applied to the gate lines based on the received control data.

In an exemplary embodiment, as shown in FIG. 1, the liquid crystal display may include three data driving units. However, the invention is not limited thereto. In an alternative exemplary embodiment, the number of the data driving units may vary. In an exemplary embodiment, the number of the backlight units maybe different from the number of the data driving units.

The gate driving unit 108 may sequentially select the gate lines G1 through Gm, and may supply the selected gate line with a voltage for turning on switching transistors connected with the selected gate line. A voltage applied to a data line may be supplied to liquid crystal capacitors Clc, which are connected with the turned-on switching transistors connected to the gate line selected by the gate driving unit 108. Since a voltage supplied to the data line is transferred to liquid crystal capacitors Clc, the amount of light penetrating the liquid crystal pixels may be controlled to display an image.

A synchronization signal for sequentially selecting the gate lines G1 through Gn may be provided to the gate driving unit 108. The synchronization signal may be provided to the gate driving unit 108 from the mater timing controller 102. However, the invention is not limited thereto. In one exemplary embodiment, for example, the synchronization signal for sequentially selecting the gate lines G1 through Gn may be provided to the gate driving unit 108 from a slave timing controller or the distributer 101. In an exemplary embodiment, the display device may further include a synchronization signal generating unit (not shown) for generating the synchronization signal.

The distributer 101 may receive image data DATA. The image data DATA may be received from a tuner of the TV broadcasting, reproduced by a playback device of contents recorded at a medium, or generated by an operation of an application program or player program using a personal computer. The image data DATA may be provided to the distributer 101.

The image data DATA may be generated on a frame-by-frame basis. When the image is displayed on a frame-by-frame basis, the image data DATA include brightness information for each pixel. In such an embodiment, the image data DATA may further include information on a relationship between previous and next frames such as a synchronization signal, for example.

The distributer 101 may distribute the image data DATA input thereto into a plurality of timing controllers, e.g., the master timing controller 102, the slave timing controller 103 and the slave timing controller 104. In an exemplary embodiment of the invention, the display device includes the plurality of data driving units 105, 106 and 107, and the liquid crystal panel 109 may be divided into a plurality of blocks, each of which includes liquid crystal pixels controlled by a corresponding data driving unit 105, 106 and 107. Each of the plurality of timing controllers 102, 103 and 104 may generate control data for controlling liquid crystal pixels in one of the plurality of blocks. In such an embodiment, the distributer 101 may divide image data DATA such that the divided image data corresponds to the blocks controlled by the timing controllers 102, 103 and 104, respectively, and may provide the divided image data to the corresponding timing controllers 102, 103 and 104.

Each of the timing controllers 102, 103 and 104 may receive corresponding image data from the distributer 101. Each of the timing controllers 102, 103 and 104 may generate control data for controlling liquid crystal pixels to output the generated control data to the corresponding data driving units 105, 106 or 107.

In an exemplary embodiment of the invention, the plurality of the timing controllers 102, 103 and 104 generates control data for controlling liquid crystal pixels in the blocks of the liquid crystal panel 109, the amount of data to be processed by one timing controller in a unit time is substantially reduced. In such an embodiment according to the invention, when the liquid crystal panel has a large size, the display device may effectively prevent an increase in a processing speed of a timing controller such that an increase in an operating frequency is also effectively prevented.

In an exemplary embodiment of the invention, each of the timing controllers 102, 103 and 104 may extract luminance distribution information of pixels of a corresponding block from image data input from the distributer 101, and may generate pixel control data based on the extracted luminance distribution information. Herein, the corresponding block may indicate a block including liquid crystal pixels controlled by a data driving unit which is supplied with control data controlling liquid crystal pixels from a timing controller.

In one exemplary embodiment, for example, the master timing controller 102 may receive luminance distribution information extracted by the slave timing controllers 103 and 104. The master timing controller 102 may calculate the amount (or, a light emitting level) of light to be generated by each of the backlight units 111, 112 and 113, and may provide the calculated amount of light to the slave timing controllers 103 and 104. Each of the slave timing controllers 103 and 104 may compensate for the transmittance of light of a liquid crystal pixel based on the amount of light calculated from the master timing controller 102. The process described above may be referred to as a pixel compensation process.

In an exemplary embodiment, the display device may include a plurality of communication paths, e.g., a first communication path 114 between the master timing controller 102 and the first slave timing controller 103 and a second communication path 115 between the master timing controller 102 and the second slave timing controller 104. The communication paths 114 and 115 may communicate using an inter-integrated circuit ("I2C") protocol. In such an embodiment, an increase in a chip size may be effectively prevented by using the I2C protocol since one communication path includes only two signal lines when the communication path uses the I2C. In such an embodiment, the reliability may be substantially increased and a cost for implementing the I2C protocol may be substantially reduced since the I2C protocol is a standard communication protocol.

Figure 2:
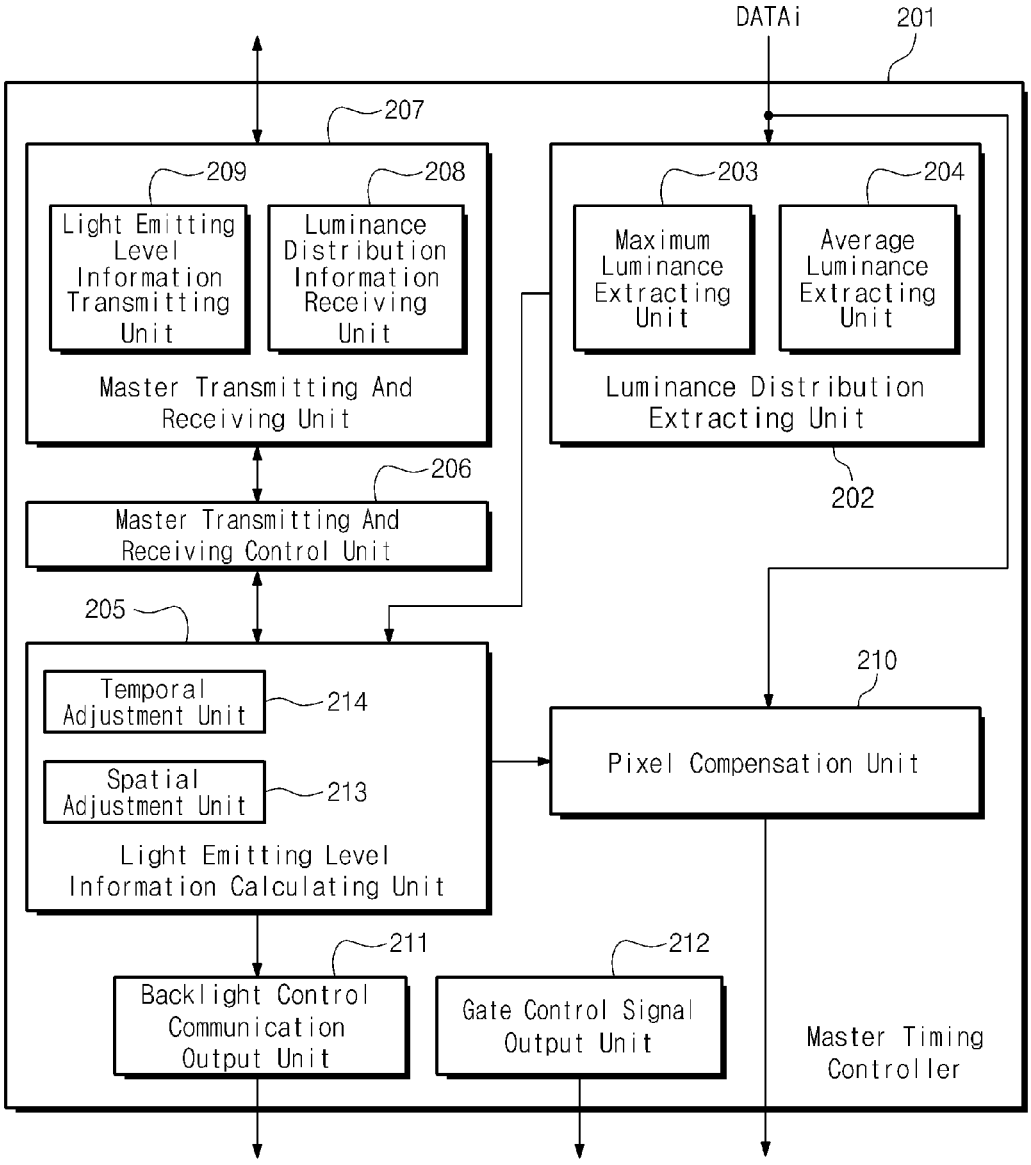
FIG. 2 is a block diagram showing an exemplary embodiment of a master timing controller according to the invention.

FIG. 2 is a block diagram showing an exemplary embodiment of a master timing controller according to the invention. FIG. 2 shows an internal structure of the master timing controller 102 illustrated in FIG. 1. Referring to FIG. 2, the master timing controller 201 may include a luminance distribution extracting unit 202, a light emitting level information calculating unit 205, a pixel compensation unit 210, a master transmitting and receiving unit 207, a master transmitting and receiving control unit 206, and a backlight control communication output unit 211. The master timing controller 201 may further include a gate control signal output unit 212.

The luminance distribution extracting unit 202 may include a maximum luminance extracting unit 203 and an average luminance extracting unit 204, and the light emitting level information calculating unit 205 may include a spatial adjustment unit 213 and a temporal adjustment unit 214. The master transmitting and receiving unit 207 may include a luminance distribution information receiving unit 208 and a light emitting level information transmitting unit 209.

The luminance distribution extracting unit 202 may extract luminance distribution information of pixels in a block assigned to the master timing controller 102 based on information of pixels of a frame of image data DATAi distributed by a distributer 101. In an exemplary embodiment, as illustrated in FIG. 2, the maximum luminance extracting unit 203 of the luminance distribution extracting unit 202 may extract a maximum luminance value of pixels of the assigned block based on information of the pixels of a frame, and the average luminance extracting unit 204 of the luminance distribution extracting unit 202 may extract an average luminance value of pixels of the assigned block based on the information of pixels of the frame. In an exemplary embodiment, the luminance distribution extracting unit 202 may extract information on dispersion of the luminance or a center value of a luminance distribution, for example.

The block assigned to the master timing controller 102 may mean a portion (or, referred to as partial image) of an image expressed by liquid crystal pixels that are controlled by a data driving unit, e.g., the first data driving unit 105, connected with the master timing controller 102. Blocks assigned to slave timing controllers 103 and 104 may be defined similarly as described above.

The master transmitting and receiving unit 207 may receive luminance distribution information from the slave timing controllers 103 and 104, and the luminance distribution information may be provided to the light emitting level information calculating unit 205 via the master transmitting and receiving control unit 206. The luminance distribution information input from the slave timing controllers 103 and 104 may include a maximum luminance value and an average luminance value.

The light emitting level information calculating unit 205 may calculate the amount of light to be transmitted to the liquid crystal pixels, which are pixels of assigned blocks to each of the master and slave timing controllers 102, 103 and 104, using the luminance distribution information, which is extracted by the luminance distribution extracting unit 202, and the luminance distribution information provided from the master transmitting and receiving unit 207.

The light emitting level information calculating unit 205 may calculate light emitting levels of backlight units. In such an embodiment, the light emitting level information calculating unit 205 may calculate the light emitting levels considering the light generated by another backlight unit added to the light generated by a corresponding backlight unit or the light arrived at liquid crystal pixels of a region assigned to the corresponding backlight unit.

In an exemplary embodiment, the light emitting level information calculating unit 205 may calculate a light emitting level of each of the backlight units from a maximum luminance value extracted by the luminance distribution extracting unit 202 and a maximum luminance value provided from the master transmitting and receiving control unit 206. The light emitting level information calculating unit 205 may calculate the amount of light corresponding to a maximum luminance of pixels of a region assigned to each of the backlight units, as a light emitting level. In such an embodiment, the light emitting level information calculating unit 205 may calculate the amount of light less than a maximum luminance of pixels of a region assigned to each backlight unit as a light emitting level, based on an average luminance value extracted by the luminance distribution extracting unit 202 and an average luminance value received by the master transmitting and receiving unit 207 and provided via the master transmitting and receiving control unit 206.

When the difference between the amounts of light extracted at adjacent backlight units is substantially large, the brightness of an image to be displayed may be varied unnaturally. In an exemplary embodiment, the spatial adjustment unit 213 of the light emitting level information calculating unit 205 may adjust the amount of light generated from each of the backlight units. In one exemplary embodiment, for example, the spatial adjustment unit 213 may adjust a difference between light emitting levels of adjacent backlight units to be within a predetermined range.

When a temporal variation of the amount of light generated by a backlight unit is substantially large, images in adjacent frames may be displayed unnaturally. In an exemplary embodiment, the temporal adjustment unit 214 of the light emitting level information calculating unit 205 may adjust a temporal variation of the amount of light such that a temporal variation of the amount of light generated by each of the backlight units becomes smooth (or slow). In one exemplary embodiment, for example, a difference between a light emitting level for displaying a current frame and a light emitting level for displaying a subsequent frame may be adjusted to be within a predetermined range.

The backlight control communication output unit 211 may generate a control signal corresponding to the calculated light emitting level in response to a light emitting level calculated by the light emitting level information calculating unit 205. The generated control signal may be a control signal for generating light from a backlight unit, and the backlight control communication output unit 211 may output the generated control signal to the backlight control unit 110. The pixel compensation unit 210 may perform pixel compensation process with respect to image data DATAi provided from the distributer 101, based on a light emitting level of each of the backlight units calculated by the light emitting level information calculating unit 205. The pixel compensation unit 210 may send a result of the pixel compensation process to a data driving unit 105 as control data.

In an exemplary embodiment, the amount of light generated at each of the backlight units is temporally or spatially varied by the light emitting level information calculating unit 205, and the pixel compensation unit 210 may compensate for the variation of the amount of light. In one exemplary embodiment, for example, when the amount of light arrived at a liquid crystal pixel from a backlight unit is substantially half of to the maximum of a light emitting level, the pixel compensation unit 210 may perform compensation such that the transmittance of light at the liquid crystal pixel is substantially doubled.

The master transmitting and receiving unit 207 may communicate with the slave timing controllers 103 and 104. A luminance distribution information receiving unit 208 of the master transmitting and receiving unit 207 may request luminance distribution information to the slave timing controllers 103 and 104, and may receive luminance distribution information from the slave timing controllers 103 and 104.

A light emitting level information transmitting unit 209 of the master transmitting and receiving unit 207 may receive the amount of light calculated by the light emitting level information calculating unit 205 via the master transmitting and receiving control unit 206, and send the calculated amount of light to the slave timing controllers 103 and 104.

The master transmitting and receiving control unit 206 may control communication of the master transmitting and receiving unit 207. In an exemplary embodiment, the communication control may include detecting whether an error occurs in a communication. In such an embodiment, a seriousness level may be given to a communication error. The communication error may include a fatal error as a serious error and a recoverable error as a minor error. In one exemplary embodiment, for example, when a response is not received within a predetermined time after information is sent to a slave timing controller, it may be determined that the fatal error occurs. The recoverable error may be an error which is generated temporarily. In one exemplary embodiment, for example, the recoverable error may include a noise generated at a communication path and an erroneous checksum where a response is received after information is sent to a slave timing controller. Here, a checksum is counting a bit number within a transfer unit to allow a receiver to check whether the same number of bits is received. If the same number of bits is received, data is considered to be received without error.

In an exemplary embodiment of the invention, the communication error may be processed based on the seriousness level. In such an embodiment, when the fatal error occurs, the light emitting level information calculating unit 205 may perform temporal adjustment on the amount of light generated by a backlight unit corresponding to a block assigned to a slave timing controller at which a corresponding error occurs, and may slowly changes the amount of light to the maximum amount. As the amount of light increasing to the maximum amount, an image may be displayed substantially naturally without pixel compensation process at a slave timing controller. In such an embodiment, the brightness of an image may be effectively prevented from being varied unnaturally by temporal adjustment, in which the amount of light is varied substantially slowly and gradually.

The gate control signal output unit 212 may generate a timing signal corresponding to timing when a signal is input to the data driving unit 105 by the pixel compensation unit 210, and may output the generated timing signal to a gate driving unit 108. The gate control signal output unit 212 may be disposed outside the master timing controller 201. In one exemplary embodiment, for example, the gate control signal output unit 212 may be disposed in the distributer 101, shown in FIG. 1.

Figure 3:
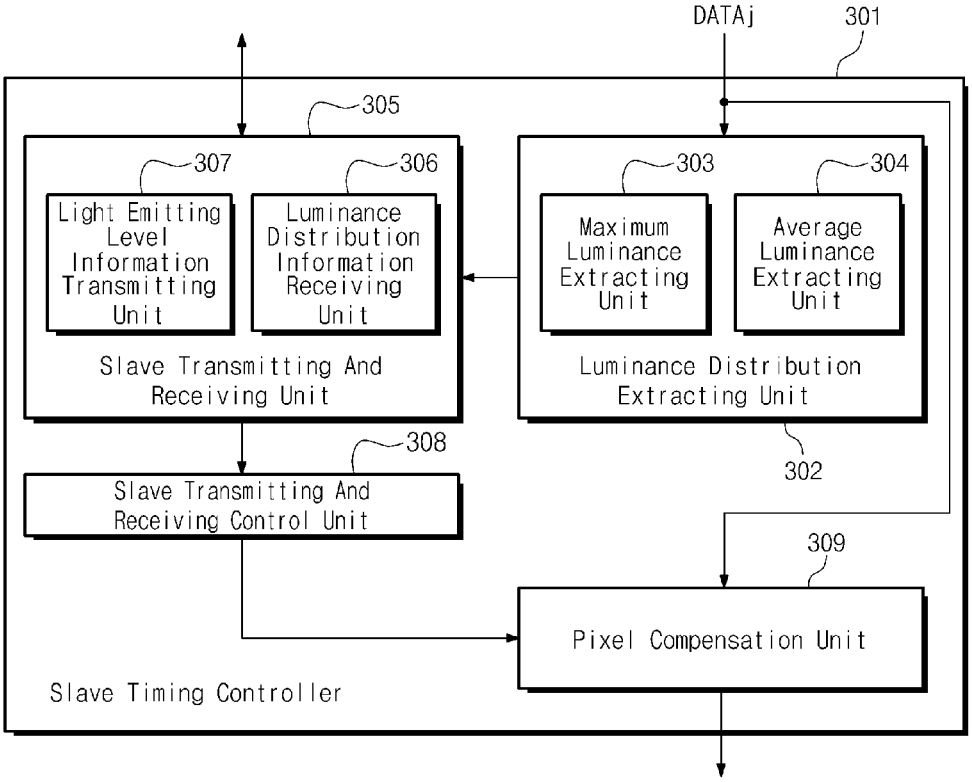
FIG. 3 is a block diagram showing an exemplary embodiment of a slave timing controller according to the invention.

FIG. 3 is a block diagram showing an exemplary embodiment of a slave timing controller according to the invention. Each of the slave timing controllers 103 and 104 illustrated in FIG. 1 may have a structure substantially the same as the structure of the slave timing controller 301 in FIG. 3. Referring to FIG. 3, the slave timing controller 301 may include a luminance distribution extracting unit 302, a slave transmitting and receiving unit 305, a slave transmitting and receiving control unit 308, and a pixel compensation unit 309. The luminance distribution extracting unit 302 may include a maximum luminance extracting unit 303 and an average luminance extracting unit 304, and the slave transmitting and receiving unit 305 may include a luminance distribution information receiving unit 306 and a light emitting level information transmitting unit 307.

The luminance distribution extracting unit 302 may extract luminance distribution information of pixels in a block assigned to the master timing controller 102 based on information of pixels of a frame of image data DATAj distributed by a distributer 101. In one exemplary embodiment, for example, the maximum luminance extracting unit 303 of the luminance distribution extracting unit 302 may extract a maximum luminance value of pixels of the assigned block based on the information of the pixels of the frame, and the average luminance extracting unit 304 of the luminance distribution extracting unit 302 may extract an average luminance value of pixels of the assigned block based on the information of the pixels of the frame. In an exemplary embodiment, the luminance distribution extracting unit 302 may extract dispersion of the luminance or a center value of a luminance distribution, for example.

The slave transmitting and receiving unit 305 may communicate with the master timing controller 102. The luminance distribution information transmitting unit 306 of the slave transmitting and receiving unit 305 may transmit luminance distribution information extracted by the luminance distribution extracting unit 302 to the master timing controller 102 in response to a request on the luminance distribution information from the master timing controller 102. The luminance distribution information receiving unit 307 of the slave transmitting and receiving unit 305 may receive information on the amount of light from the master timing controller 102. The information on the amount of light from the master timing controller 102 may be information on the amount of light to be generated by a backlight unit.

The slave communication control unit 308 may control the slave transmitting and receiving unit 305. In an exemplary embodiment, the communication control may include detecting whether an error occurs in a communication. The slave communication control unit 308 may provide the pixel compensation unit 309 with information on the amount of light received by the light emitting level information receiving unit 307.

The pixel compensation unit 309 may perform pixel compensation process with respect to image data DATAj provided from a distributer 101, based on information on the amount of light provided via the slave communication control unit 308. The pixel compensation unit 309 may transmit the compensated image data to a data driving unit corresponding to the slave timing controller 301 as a control data.

In an exemplary embodiment of the invention, when a serious error is detected by the slave communication control unit 308, the pixel compensation unit 309 may compensate for the image data for the pixels such that a backlight unit slowly increases an amount of light for the pixels to the maximum amount. When a minor error occurs, the pixel compensation unit 309 may compensate for the image data for the pixels based on information on the amount of light, which is previously received via the slave communication control unit 308.

In an exemplary embodiment, the slave timing controller 301 may further include a constituent element corresponding to a light emitting level information calculating unit 205 in FIG. 2. In such an embodiment, the constituent element may calculate a light emitting level of a backlight unit based on luminance distribution information extracted by the luminance distribution extracting unit 302. In such an embodiment, the slave timing controller 301 may substantially normally operate even when light emitting level information is not received from the master timing controller 102. In an exemplary embodiment, the slave timing controller 301 and the master timing controller 102 may be implemented by the same integrated circuit ("IC"). In such an embodiment, the IC may operate as the slave timing controller 301 or the master timing controller 102 by setting of a jump line.

Figure 4:
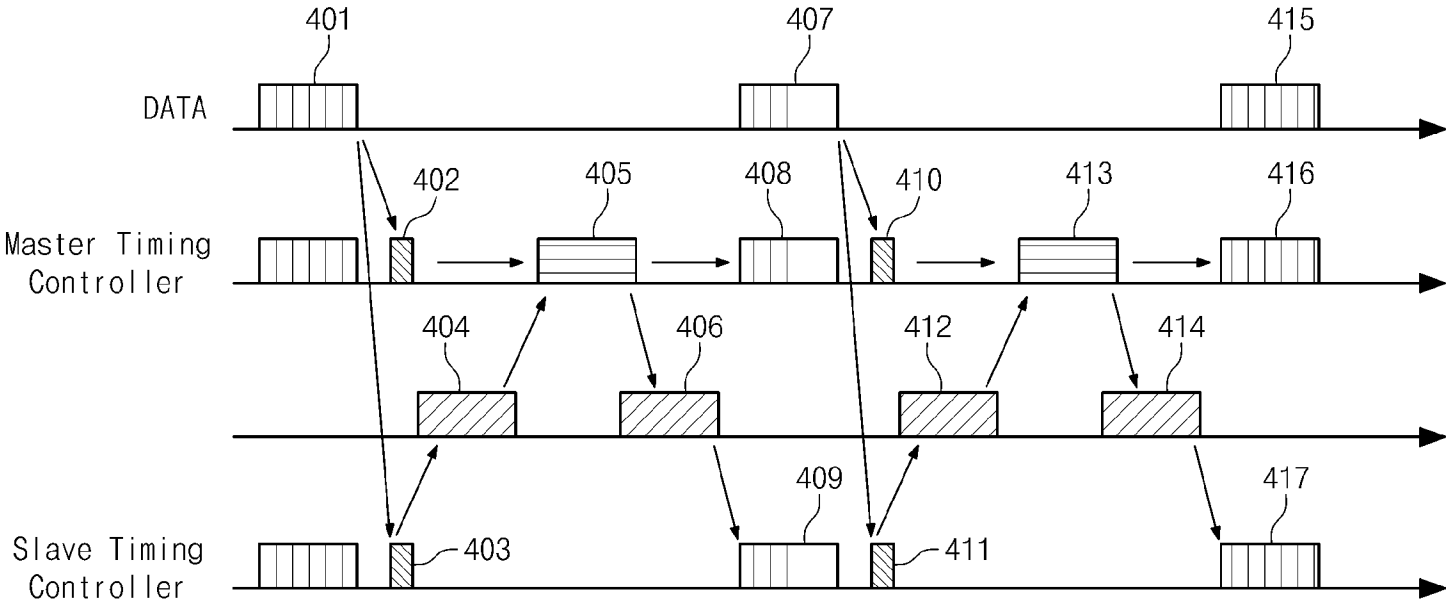
FIG. 4 is a signal timing diagram showing signals of a master timing controller and a slave timing controller of an exemplary embodiment of the display device according to the invention.

FIG. 4 is a signal timing diagram showing signals of a master timing controller and a slave timing controller of an exemplary embodiment of the display device according to the invention.

Referring to FIGS. 1 and 4, a distributer 101 may receive image data (DATA) 401, and may distribute the input image data to a master timing controller 102 and a slave timing controller 103 or 104. The master timing controller may extract luminance distribution information 402 of the provided image data, and the slave timing controller may extract luminance distribution information 403 of the provided image data. The slave timing controller 103 or 104 may transmit the extracted luminance distribution information 403 to the master timing controller. The extracted luminance distribution information 403 may be provided to the master timing controller via a communication path 115 or 114 as transmission data 404.

The master timing controller 102 may calculate light emitting level information 405 using the extracted luminance distribution information 402 and the luminance distribution information 403 extracted from the slave timing controller 103 or 104. The calculated light emitting level information 405 may be sent to the slave timing controller via the communication path 114 or 115 as transmission data 406.

The master timing controller 102 may perform pixel compensation based on the calculated light emitting level information 405 to transmit a compensated image data 408 by the pixel compensation to a data driving unit 105. The slave timing controller 103 or 104 may receive the transmission data 406, and may perform pixel compensation based on the input transmission data 406. The slave timing controller 103 or 104 may output a compensated image data 409 by the pixel compensation to a data driving unit 106 or 107.

When the compensated image data is sent to a data driving unit, subsequent image data 407 may be provided to the distributer 101, and the distributer 101 may distribute the provided subsequent image data 407 to the master timing controller 102 and the slave timing controller 103 or 104. The master timing controller 102 may extract luminance distribution information 410 of the provided subsequent image data 407, and the slave timing controller 103 or 104 may extract luminance distribution information 411 of the provided subsequent image data 407. The slave timing controller 103 or 104 may transmit the extracted luminance distribution information 411 to the master timing controller 102. The extracted luminance distribution information 411 may be provided to the master timing controller via the communication path 114 or 115 as transmission data 412.

The master timing controller 102 may calculate light emitting level information 413 using the extracted luminance distribution information 410 and the luminance distribution information 411 extracted from the slave timing controller 103 or 104. The calculated light emitting level information 413 may be sent to the slave timing controller 103 or 104 via the communication path 114 or 115 as transmission data 414.

The master timing controller 102 may perform pixel compensation based on the calculated light emitting level information 413 to transmit a compensated subsequent image data 416 by the pixel compensation to the data driving unit 105. The slave timing controller 103 or 104 may receive the transmission data 414, and may perform pixel compensation based on the input transmission data 414. The slave timing controller 103 or 104 may output a compensated subsequent image data 417 by the pixel compensation to the data driving unit 106 or 107.

When the compensated image data 416 and 417 are transmitted to the data driving units 105, 106 and 107, another subsequent image data 415 may be provided to the distributer 101.

In an exemplary embodiment, the transmission data 404, 406, 412 and 414 transmitted and received between the master timing controller 102 and the slave timing controller 103 or 104 may not arrive at a destination or may be changed during transmission.

In one exemplary embodiment, for example, an error may occur when the transmission data 404 may not arrive at the master timing controller 102. In such an embodiment, it may be determined that an error occurs when the master timing controller 102 send a request on luminance distribution information to the slave timing controller 103 or 104 and luminance distribution information is not received within a predetermined time. This error may be referred to as a time-out error. When the time-out error is detected, the master timing controller may set a light emitting level of a backlight unit, which is assigned to a region of liquid crystal pixels corresponding to the pixels of a block assigned to the slave timing controller, to the maximum level.

In an exemplary embodiment, an error may occur when transmitted luminance distribution information is different from received luminance distribution information. The slave timing controller 103 or 104 may add data for error detection, e.g., a checksum, to luminance distribution information 405. The master timing controller 102 may acquire a checksum of transmission data 404 received from the slave timing controller 103 or 104. The master timing controller 102 may compare the acquired checksum with data for error detection to determine whether transmitted luminance distribution information is different from received luminance distribution information, which may be referred to as a checksum error. When the checksum error is detected, the master timing controller 102 may discard the transmission data 404, and may calculate light emitting level information 405 using previous transmission data transmitted before the transmission data 404.

In an exemplary embodiment, an error may occur when the light emitting level information 405 does not arrive at the slave timing controller 103 or 104. In an exemplary embodiment, an error may be detected when the slave timing controller 103 or 104 send a request on light emitting level information 405 to the master timing controller 102 and light emitting level information 405 is not received within a predetermined time. This error may be referred to as a time-out error. When the time-out error is detected, the slave timing controller 103 or 104 may perform the pixel compensation process such that a light emitting level of a backlight unit assigned to a region of liquid crystal pixel corresponding to the pixels of a block assigned to the slave timing controller is varied into the maximum level.

In an exemplary embodiment, an error may occur when the transmitted light emitting level information is different from received light emitting level information. In an exemplary embodiment, the master timing controller 102 may add data for error detection, e.g., a checksum, to light emitting level information 405. The slave timing controller 103 or 104 may obtain a checksum of light emitting level information 405 received from the master timing controller 102. The slave timing controller 103 or 104 may compare the acquired checksum with the data for error detection to detect whether the transmitted light emitting level information is different from received light emitting level information, as a checksum error. When the checksum error is detected, the slave timing controller 103 or 104 may discard the transmission data 406, and may perform pixel compensation process using previous transmission data transmitted before the transmission data 406.

Figure 5:
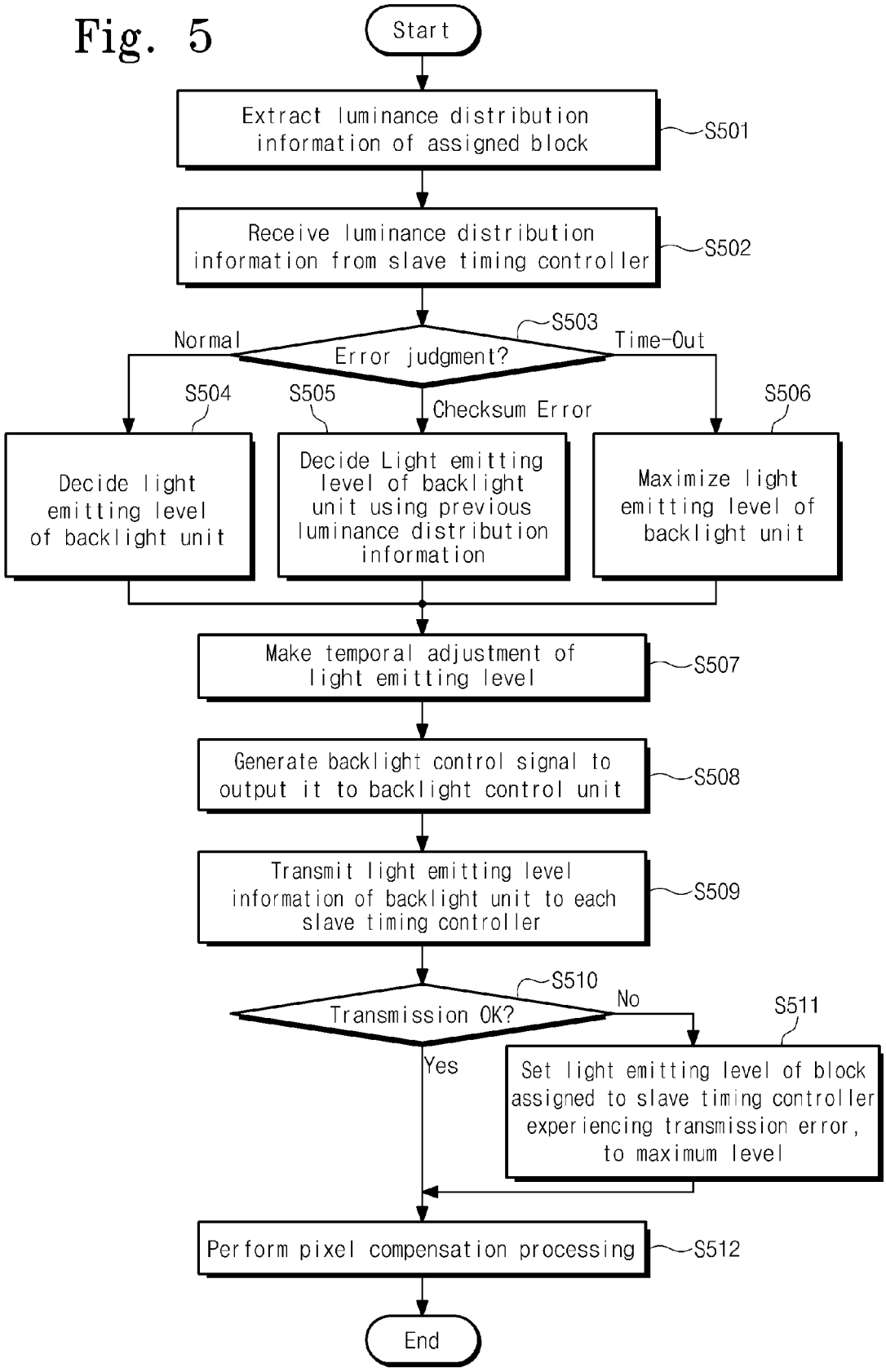
FIG. 5 is a flowchart showing an exemplary embodiment of a method of operating a master timing controller according to the invention.

FIG. 5 is a flowchart showing an exemplary embodiment of a method of operating a master timing controller according to the invention.

In an exemplary embodiment, as shown in operation S501, luminance distribution information of an assigned block may be extracted by slave timing controllers. As shown in operation S502, a master transmitting and receiving unit 207 and a master transmitting and receiving control unit 206 may receive the luminance distribution information from each slave timing controller. As shown in operation S503, it is determined whether an error occurs in the luminance distribution information received in operation S502 by the master transmitting and receiving control unit 206. In an exemplary embodiment, when no error occurs is detected in the luminance distribution information from the slave timing controller, the method proceeds to operation S504, in which a light emitting level of each backlight unit is calculated.

In an exemplary embodiment, when a checksum error is detected in the luminance distribution information from the slave timing controller, the method proceeds to operation S505, in which a light emitting level is calculated using previous luminance distribution information received from a slave timing controller before the checksum error is detected.

In an exemplary embodiment, when the time-out error is detected in the luminance distribution information from the slave timing controller, the method proceeds to operation S506, in which a light emitting level of a backlight unit, which is assigned to a region of liquid crystal pixels corresponding to the pixels of a block assigned to the slave timing controller at which the time-out error is detected, may be set to the maximum level.

After operations S504, S505 and S506, the method proceeds to a next operation, e.g., operation S507, in which temporal adjustment on a light emitting level is made by a temporal adjustment unit 214. In an alternative exemplary embodiment, spatial adjustment may be made by a spatial adjustment unit 213.

As shown in operation S508, a backlight control signal may be generated, and the generated backlight control signal may be output to a backlight control unit 110 by a backlight control communication output unit 211.

As shown in operation S509, light emitting level information of a backlight unit may be sent to each slave timing controller by the master transmitting and receiving control unit 206 and the master transmitting and receiving unit 207.

As shown in operation S510, it may be determined whether the transmission in operation S509 is performed without an error. In one exemplary embodiment, for example, whether the transmission in operation S509 is performed without an error may be determined based on an acknowledgment of receipt of the transmission signal from the master timing controller 102. In an exemplary embodiment, when the transmission in operation S509 is perform with an error, a light emitting level of the pixels in a block corresponding to a slave timing controller, from which the transmission error occurs, may be set to the maximum level.

After performing operations S510 and S511, the method proceeds to a next operation, e.g., operation S512, in which a compensated image data is output to a data driving unit 105.

Figure 6:
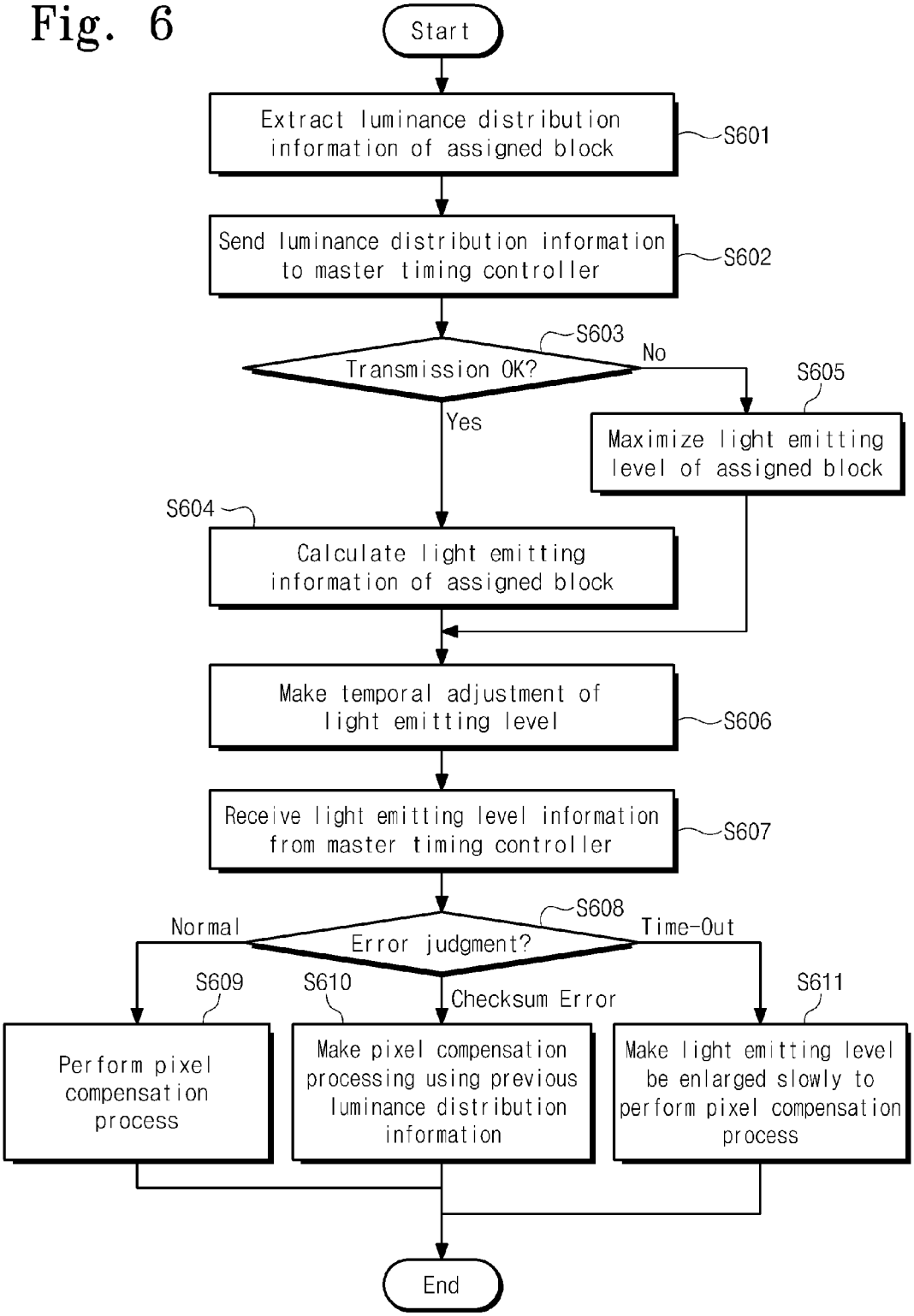
FIG. 6 is a flowchart showing an exemplary embodiment of a method of operating a slave timing controller according to the invention.

FIG. 6 is a flowchart showing an exemplary embodiment of a method of operating a slave timing controller according to the invention.

As shown in operation S601, a luminance distribution extracting unit 302 may extract luminance distribution information of an assigned block.

As shown in operation S602, a slave transmitting and receiving unit 305 may send luminance distribution information to a master timing controller 102. In operation S603, a slave communication control unit 308 may determine whether a transmission in operation S602 is performed without an error. In one exemplary embodiment, for example, it may be determined whether the transmission in operation S602 is performed without an error based on an acknowledgment of receipt of the transmission signal from the master timing controller 102.

In an exemplary embodiment, when the transmission is performed without an error, the method proceeds to operation S604, in which a light emitting level of a backlight unit of a block is calculated for a state where the light emitting level information is not received from the master timing controller 102.

When an error is detected, the method proceeds to operation S605, in which a light emitting level of a backlight unit of an assigned block is calculated to be the maximum value for the state where the light emitting level information is not received from the master timing controller 102.

After performing operations S604 and S605, the method proceeds to a next operation, e.g., operation S606, in which a light emitting level calculated at previous operation, e.g., operation S604 or S605, is temporally adjusted. The temporal adjustment may be performed to prevent brightness of a block in charge of a slave timing controller from being substantially increased when no light emitting level information is received from the master timing controller 102. In an exemplary embodiment, operations S603, S604, S605 and S606 may be omitted.

As shown in operation S607, the light emitting level information may be received from the master timing controller by the slave communication control unit 308 and the slave transmitting and receiving unit 305.

As shown in operation S608, it is determined whether the light emitting level information in operation S607 is transmitted without an error.

When there is an error in the light emitting level information in operation S607, the method proceeds to operation S609, in which pixel compensation process is performed by a pixel compensation unit 309.

When a checksum error is detected in operation S608, the method may proceed to operation S610, in which a pixel compensation process may be performed using previous light emitting level information received from the master timing controller before the checksum error. In an alternative exemplary embodiment, when a checksum error is detected in operation S608, the pixel compensation process may be performed using the light emitting level information which is calculated in operation S604 and temporally adjusted in operation S606.

When a time-out error is detected in operation S608, the method proceed to operation S611, in which the pixel compensation process may be performed by slowly setting a light emitting level to the maximum value. In an alternative exemplary embodiment, when a time-out error is detected in operation S608, the pixel compensation process may be performed using the light emitting level information which is calculated in operation S605 and temporally adjusted in operation S606.

Figure 7:
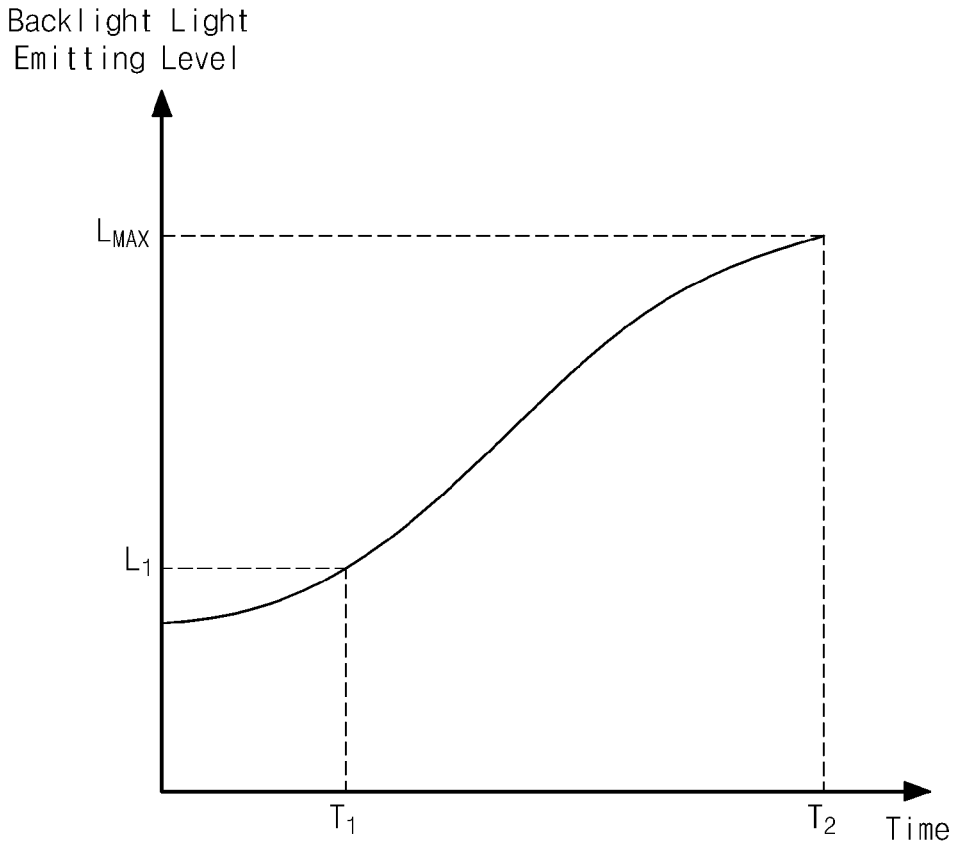
FIG. 7 is a graph illustrating light emitting level versus time where a light emitting level of the backlight unit slowly changes to the maximum level.

FIG. 7 is a graph illustrating light emitting level versus time where a light emitting level of the backlight unit slowly changes to the maximum level slowly.

Referring to FIG. 7, in an exemplary embodiment, where a light emitting level of a backlight unit is L1 at T1 and is slowly set to the maximum value at a time following T1, e.g., T2, the light emitting level may be increased slowly or smoothly to the maximum level $L_{MAX}$ by time T2, not increased sharply thereto.

In an exemplary embodiment, a display device may effectively prevent an increase in an operating frequency of a driving circuit although the number of pixels in a liquid crystal panel increases and may display a natural image although an error is generated during a display process.

While the invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display device comprising:

a liquid crystal panel including a plurality of regions, wherein each of the plurality of regions includes a plurality of liquid crystal pixels;

a plurality of data driving units; and a plurality of timing controllers, wherein the plurality of data driving units is in a one-to-one correspondence with the plurality of regions, wherein each of the plurality of data driving units controls transmittance of light of the plurality of liquid crystal pixels in a corresponding region thereof, wherein the plurality of timing controllers is in a one-to-one correspondence with the plurality of data driving units, wherein each of the plurality of timing controllers acquires data of a partial image to be displayed at the corresponding region of a corresponding data driving unit thereof, generates control data for controlling the transmittance of light of the plurality of liquid crystal pixels in the corresponding region of the corresponding data driving unit thereof, and outputs the control data to the corresponding data driving unit thereof, wherein each of the plurality of timing controllers comprises:

a luminance distribution extracting unit which extracts luminance distribution information of the partial image, wherein each of the plurality of timing controllers is one of a master timing controller and a slave timing controller, and wherein the master timing controller sends a request on the luminance distribution information to the slave timing controller.

2. The display device of claim 1, further comprising:

a plurality of backlight units;

wherein each of the plurality of backlight units emits light to the plurality of the liquid crystal pixels controlled by one of the plurality of data driving units, wherein each of the plurality of timing controllers further comprises:

a pixel compensation unit which compensates for the transmittance of light of the plurality of liquid crystal pixels in the corresponding region of the corresponding data driver based on a light emitting level of the plurality of backlight units, and wherein the master timing controller of the plurality of timing controllers calculates a light emitting level of each of the plurality of backlight units based on the luminance distribution information extracted by the luminance distribution extracting unit of the plurality of timing controllers.

3. The display device of claim 2, wherein when the master timing controller of the plurality of timing controllers does not receive a response to the request on the luminance distribution information from the slave timing controller of the plurality of timing controllers within a predetermined time, the master timing controller of the plurality of timing controllers sets a light emitting level of a backlight unit, which emits light to the plurality of liquid crystal pixels controlled by the corresponding data driving unit of the slave timing controller of the plurality of timing controllers, to a maximum level.

4. The display device of claim 2, wherein when a checksum error occurs at the luminance distribution information received as a response to the request on the luminance distribution information to the slave timing controller of the plurality of timing controllers, the master timing controller of the plurality of timing controllers calculates the light emitting level of each of the plurality of backlight units based on previous luminance distribution information received from the slave timing controller of the plurality of timing controllers before the checksum error.

5. The display device of claim 3, wherein the master timing controller of the plurality of timing controllers controls the light emitting level of each of the plurality of backlight units to be varied gradually.

6. The display device of claim 4, wherein the master timing controller of the plurality of timing controllers controls the light emitting level of each of the plurality of backlight units to be varied gradually.

7. A method of controlling a display device which includes a plurality of regions, each having a plurality of liquid crystal pixels, a plurality of data driving units, and a plurality of timing controllers, each of the plurality of data driving units corresponding to one of the plurality of regions and controlling transmittance of light of the plurality of liquid crystal pixels in a corresponding region thereof, and each of the plurality of timing controllers corresponding to one of the plurality of data driving units, the method comprising:

acquiring data of a partial image to be displayed at the corresponding region of a corresponding data driving unit of the plurality of timing controllers, generating control data for controlling the transmittance of light of the plurality of liquid crystal pixels in the corresponding region of the corresponding data driving unit of the plurality of timing controllers, and providing the control data to the corresponding data driving unit of the plurality of timing controllers, wherein each of the plurality of timing controllers comprises:

a luminance distribution extracting unit which extracts luminance distribution information of the partial image;

wherein each of the plurality of timing controllers is one of a master timing controller and a slave timing controller, and wherein the master timing controller sends a request on the luminance distribution information to the slave timing controller.

8. The method of claim 7, wherein the display device further comprises a plurality of backlight units, each of the plurality of backlight units emits light to the plurality of liquid crystal pixels controlled by a corresponding data unit of the plurality of data driving units, each of the plurality of timing controllers further comprises:

a pixel compensation unit which compensates for the transmittance of light of the plurality of liquid crystal pixels in the corresponding region of the corresponding data driver thereof based on a light emitting level of the plurality of backlight units, the master timing controller of the plurality of timing controllers calculates a light emitting level of each of the plurality of backlight units based on luminance distribution information extracted by the luminance distribution extracting unit of the plurality of timing controllers.

9. The method of claim 8, wherein when the master timing controller of the plurality of timing controllers does not receive a response to the request on the luminance distribution information from the slave timing controller of the plurality of timing controllers within a predetermined time, the master timing controller of the plurality of timing controllers sets a light emitting level of a backlight unit, which emits light to the plurality of liquid crystal pixels controlled by the corresponding data driving unit of the slave timing controller of the plurality of timing controllers, to a maximum level.

10. The method of claim 8, wherein when a checksum error occurs at the luminance distribution information received as a response to the request on the luminance distribution information to the slave timing controller of the plurality of timing controllers, the master timing controller of the plurality of timing controllers calculates the light emitting level of each of the plurality of backlight units based on luminance distribution information previously received from the slave timing controller of the plurality of timing controllers before the checksum error.

11. The method of claim 9, wherein the master timing controller of the plurality of timing controllers controls the light emitting level of each of the plurality of backlight units to be varied gradually.

12. The method of claim 10, wherein the master timing controller of the plurality of timing controllers controls the light emitting level of each of the plurality of backlight units to be varied gradually.

* * * * *